US005738340A

United States Patent [19]

Brantner

[11] Patent Number: 5,738,340

[45] Date of Patent: Apr. 14, 1998

[54] STIRRUP DEVICE AND METHOD

[76] Inventor: Charles U. Brantner, R.R. 1, Moorhead, Minn. 56560

[21] Appl. No.: 717,089

[22] Filed: Sep. 20, 1996

[51] Int. Cl.[6] ..... B66D 1/00

[52] U.S. Cl. ..... 254/337; 254/362; 54/47

[58] Field of Search ..... 54/47, 48, 46.1; 254/362, 336, 337

[56] References Cited

U.S. PATENT DOCUMENTS

| | | | |
|---|---|---|---|
| 2,446,964 | 8/1948 | Stone | 464/51 |
| 4,151,981 | 5/1979 | Gennep | 254/375 |
| 5,347,797 | 9/1994 | Seat et al. | 54/47 |

FOREIGN PATENT DOCUMENTS

| | | | |
|---|---|---|---|
| 2258772 | 8/1975 | France | 54/47 |
| 105949 | 1/1899 | Germany | 54/47 |
| 82581 | 12/1913 | Germany | 54/46.1 |

*Primary Examiner*—Katherine Matecki

*Attorney, Agent, or Firm*—Merchant, Gould, Smith, Edell, Welter & Schmidt, P.A.

[57] ABSTRACT

A stirrup device is provided which has a mounting piece to secure a saddle, a large vehicle, or another apparatus. A drum is rotatably attached to the mounting piece. A pulley system has an attached stirrup and is operably connected to the drum for lifting and lowering the stirrup. A cable operably connects the pulley system to the drum. The drum is adapted to receive a force to rotate the drum such that the stirrup is raised or lowered depending upon the direction of rotation of the drum. The drum may be adapted to receive a cordless electric drill for rotation of the drum. Alternatively, the drum may be secured to an electric motor or the like for imparting a rotating force on the drum.

17 Claims, 3 Drawing Sheets

STIRRUP DEVICE AND METHOD

TECHNICAL FIELD

The present invention relates generally to a lifting apparatus. More particularly, the present invention relates to a stirrup device for lifting or lowering a person and a method for doing the same.

BACKGROUND

Generally, a person mounting a large animal such as a horse, a large vehicle, or other apparatus must have strength and agility to successfully mount the animal, vehicle, or apparatus. Horse saddles with stirrups are generally used on horses for mounting and riding the horses. Horse saddles typically have two stirrups hanging by straps, which can be adjusted to fit the length of the rider's legs. When mounting the horse, however, the rider generally must lift his or her foot very high just to engage the stirrup. Once the rider's foot is firmly placed in the stirrup, the rider then pulls himself up onto the top of the horse, swinging the other leg around to the opposite side of the horse. This procedure requires agility of the rider to lift his leg to the level of the stirrup and strength of the rider to pull his weight onto the top of the horse.

Other large vehicles and apparatus, such as farm equipment, present similar problems for persons mounting such objects. Typically, for example, a large tractor has a foot hold into which a person's foot can be placed. The person can then pull himself up onto the top of the tractor. This procedure is similar to mounting a horse in that the person must have agility and strength to mount the vehicle or apparatus.

For individuals with a lesser degree of agility and strength, such as, for example, elderly and physically handicapped individuals, mounting a large animal such as a horse, or mounting other large vehicles or apparatus, can be extremely difficult, and in some cases impossible. Even if such individuals are able to successfully mount the animal or apparatus, dismounting can be difficult depending upon the height of the animal or apparatus, and upon the ability of the rider to lower himself to the ground without falling.

The present invention provides a solution to this and other problems and offers other advantages over the prior art.

SUMMARY

The present invention relates to a stirrup lifting device for lifting a person onto an animal, large vehicle or other apparatus. The stirrup device includes a mounting piece with a rotatably attached drum. The mounting piece is attachable to a fixed apparatus. The rotatable drum is configured to operably receive a force for rotating the drum. A pulley system is operably connected to the drum and has a stirrup operably attached to it, which is configured to receive a foot of the person. A cable engages the drum and the pulley system. As the drum is rotated in the first direction, the stirrup moves upwardly, thereby lifting the person whose foot is held in the stirrup.

In accordance with one embodiment of the invention, the drum can be rotated by an electric drill imparting a rotating force on the drum. Alternatively, an electric motor can be operably attached to the drum and activated to impart a rotating force on the drum.

In accordance with another embodiment of the invention an extended flexible shaft has one end operably connected to the drum. An opposite end of the flexible shaft is configured to receive a tool end of an electric drill for rotation therewith as the tool end of the drill is rotated.

These and various other features as well as advantages that characterize the present invention will be apparent upon reading of the following detailed description and review of the associated drawings.

DETAILED DESCRIPTION

With reference to the drawings in which like elements are numbered identically throughout, a detailed description of the invention is provided. This description does not limit the scope of the invention, which is limited only by the scope of the attached claims.

In general terms, the present invention relates to a stirrup device 10. The stirrup device 10 has a mounting piece 12, which has a substantially parallel mounting strip 14 connected by flange 16. In one embodiment the mounting piece 12 is a plate made of a substantially inflexible material, such as, for example, steel. The mounting piece 12, however, could have many different physical configurations, using other types of materials, so long as its construction permits operable attachment to a saddle or some fixed portion of a large vehicle or other apparatus.

Figure 1:
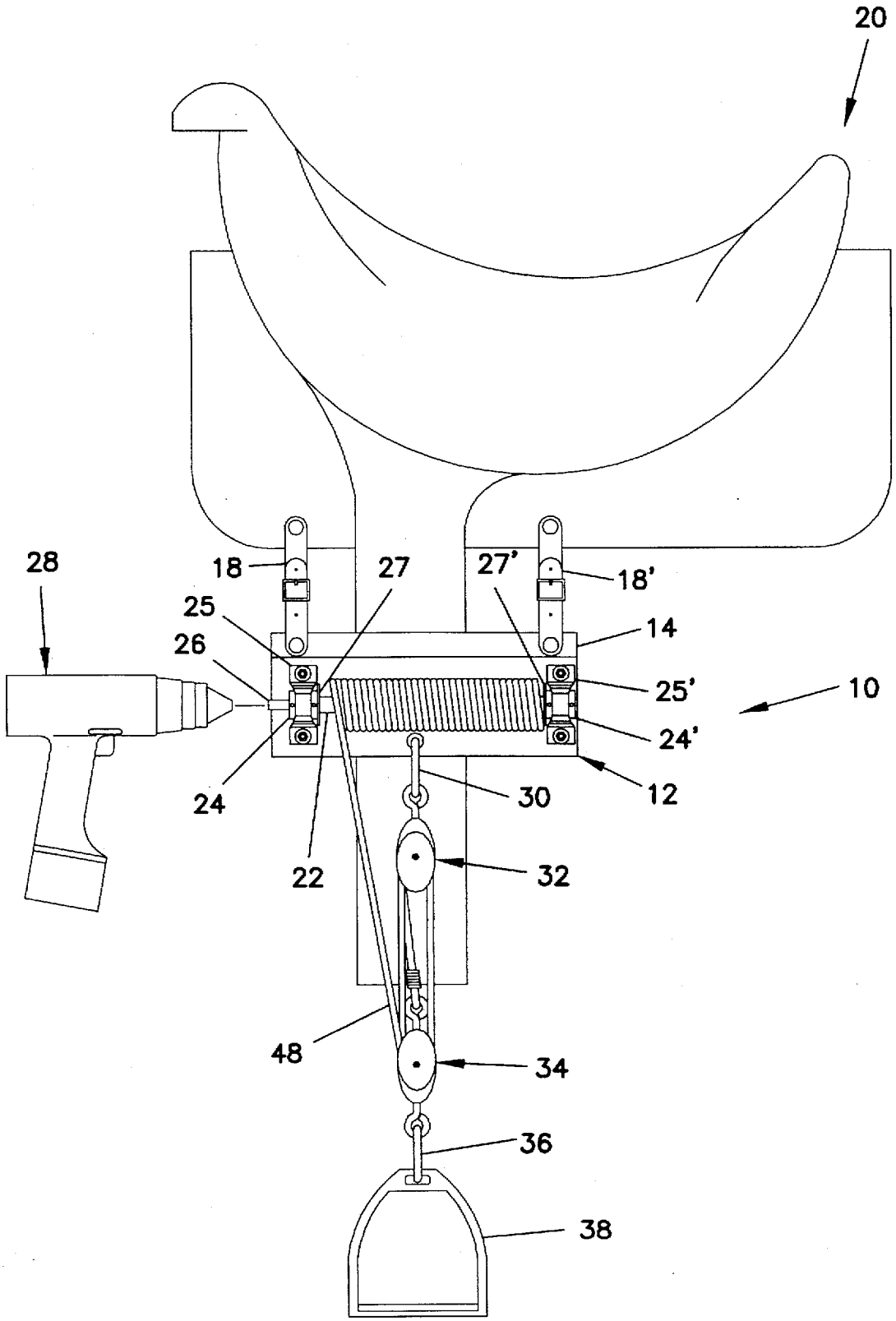
FIG. 1 is a front elevation view of a stirrup device of the present invention attached to a horse saddle and showing a cordless electric drill aligned with the stirrup device for engagement therewith.

The mounting strip 14 has two fasteners 18 and 18', each connected adjacent to an end of the mounting strip 14. In one embodiment shown in FIG. 1, the fasteners are mounting straps having buckles to adjustably secure the straps in a locked position. In FIG. 1, the fasteners 18 and 18' are secured to a portion of a saddle 20. The saddle 20, shown in FIG. 1, is generally the type of saddle secured to a horse and used as a seat for a rider. It will be apparent that the present invention could also be attached to a saddle configured for use on other types of animals or apparatus.

A drum 22 is rotatably held at each end by bearings 24 and 24'. The bearings 24 and 24' are disposed in bearing holders 25 and 25', respectively, which are bolted to the mounting piece 12. Opposing plates 27 and 27' are disposed adjacent to bearings 24 and 24' respectively, and each has a bore through which the drum 22 extends. One end of the drum 22 has an axial shaft 26 extending beyond the bearing 24 and configured to receive a rotating force imparted by a tool end of a cordless electric drill 28. It will be apparent that a non-cordless drill could also be used. However, a cordless electric drill is advantageous, because it can be used in almost any location without regard to whether a separate, adaptable electric power supply is available.

Figure 2:
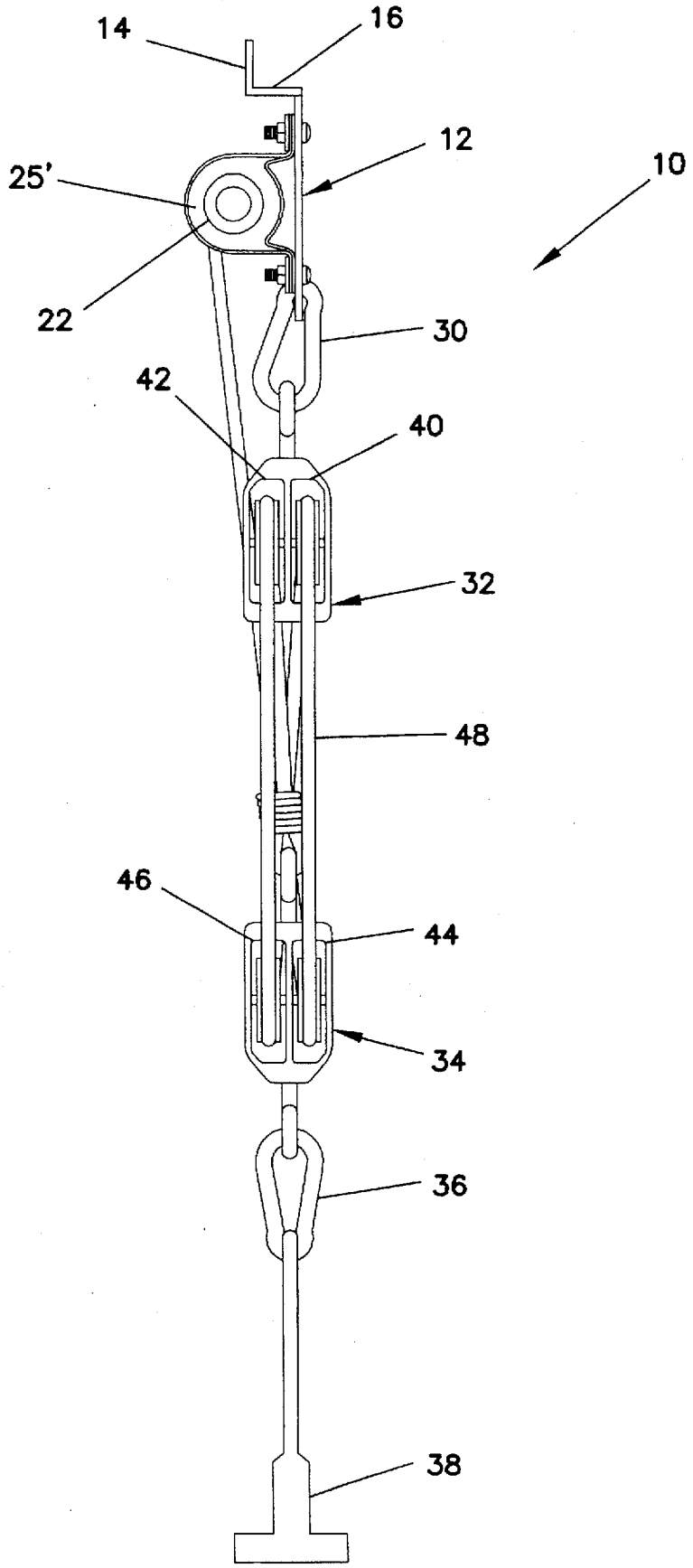
FIG. 2 is a right side elevation view of the stirrup device of FIG. 1.

An eyelet 30 couples the mounting piece 12 to a first set of pulleys 32. A second eyelet 36 couples a second set of pulleys 34 to a stirrup 38. As shown in FIG. 2, in one preferred embodiment the first set of pulleys 32 comprises two axially aligned pulley wheels 40 and 42. Similarly, the second set of pulleys 34 comprises two axially aligned pulley wheels 44 and 46.

The two sets of pulleys 32 and 34 are operably connected by a cable 48. In one preferred embodiment, the cable 48 is a rope made of nylon, although any suitable material may be used. It will be apparent to those skilled in the art that any cable, such as, for example, any belt, band, cord, rope, or chain could be used to operably connect the two sets of pulleys and the drum to produce a pulley system. One end of the cable 48 is fixedly secured to the drum 22 and an opposite end is fixedly secured to the second set of pulleys 34. The opposing plates 27 and 27' prevent the cable 48 from becoming entangled in the bearings 24 and 24' and the bearing holders 25 and 25' when the drum 22 is rotated. The cable 48 extends from the drum 22 around the first pulley wheel 44 of the second set of pulleys 34, up to and around the first pulley wheel 40 of the first set of pulleys 32, down to and around the second pulley wheel 46 of the second set of pulleys 34, up to and around the second pulley wheel 42 of the first set of pulleys 32 and down to the fixed attachment at the second set of pulleys 34. It will be apparent to those in the art that this pulley arrangement is generally known as a block and tackle arrangement. It will also be apparent to those in the art that any number of pulley wheels can be used within each set of pulleys. For example, a single pulley wheel could be used in the first set of pulleys and a single pulley wheel could be used in the second set of pulleys. The more pulley wheels utilized, the less force that is required to raise the stirrup and load of the person standing in the stirrup.

Figure 3:
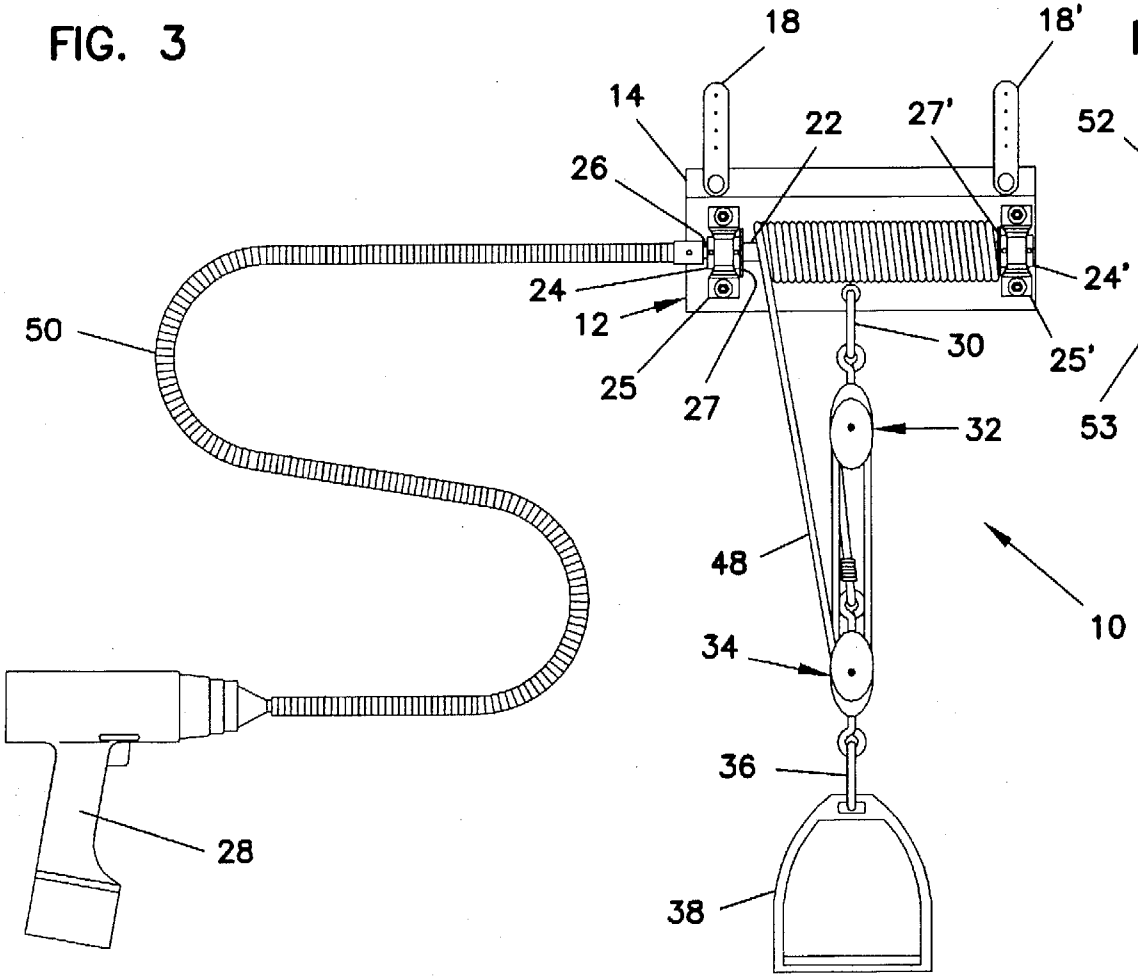
FIG. 3 is a front elevation view of an alternative embodiment of the stirrup device of the present invention having a flexible shaft operably attached to the drum.

FIG. 3 shows an alternative embodiment of the present invention. The configuration shown in FIG. 3 is substantially the same as the configuration of the stirrup device 10 shown in FIG. 1. However, the axial shaft 26 is connected to one end of an extended flexible shaft 50. An opposite end of the extended flexible shaft 50 is configured to receive a rotating force from the tool end of the cordless electric drill 28 for rotation therewith when the tool end of the drill is rotated. The extended flexible shaft 50 permits a user to hold the electric drill in a comfortable position and move the drill 28 as needed while the drum 22 is being rotated to raise or lower the stirrup 38.

Figure 4:
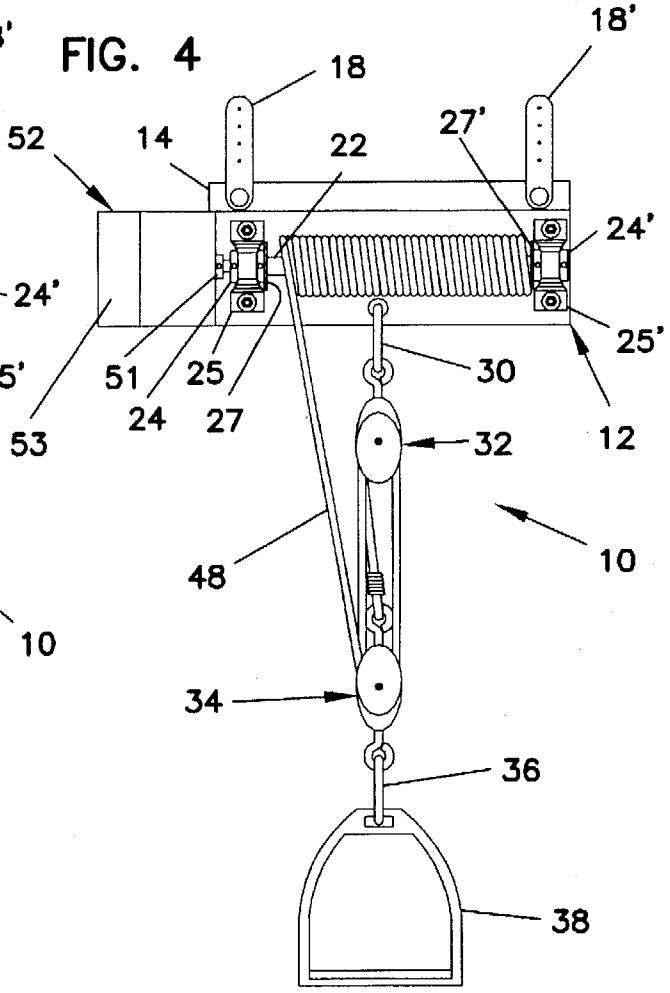
FIG. 4 is a front elevation view of an alternative embodiment of the present invention having an electric motor operably connected to the drum.

FIG. 4 also shows an alternative embodiment of the present invention. The configuration shown in FIG. 4 is substantially the same as the configuration of the stirrup device 10 shown in FIG. 1. However, the axial shaft 26 is operably attached to an electric motor 52 by a bearing 51. The motor 52 is manually activated by means of a switch 53 to rotate the axial shaft 26 and thereby rotate the drum 22 in a clockwise direction or a counterclockwise direction as desired by the user. Electric motors that produce a mechanical rotating force are well known in the art. This configuration eliminates the need for carrying an electric drill to operate the stirrup device 10. The motor 52 can be powered by disposable batteries, a rechargeable battery pack, or connection to an a/c power source. It will be apparent that other means can be configured to rotate the axial shaft 26.

When used to assist a rider in mounting a large animal such as a horse, the stirrup device 10 is preferably mounted to a portion of the saddle 20 such that the stirrup 38 hangs from the saddle 20 in alignment with normal placement of a stirrup from the saddle. For use with large vehicles or other apparatus, the stirrup device should be mounted such that the user can access the seat or desired mounting area by raising the stirrup.

With reference to the embodiment shown in FIG. 1, prior to mounting the animal, or other large vehicle or apparatus, the tool end of the electric drill 28 is inserted into the axial shaft 26, and rotated in a clockwise direction to unwind the cable 48 from the drum 22. As the electric drill 28 rotates the drum 22 and unwinds the cable 48, the second set of pulleys 34 with the attached stirrup 38 moves downwardly away from the first set of pulleys 32. Once the stirrup 38 reaches a position at which the user can easily insert a foot into the stirrup 38, the user inserts the foot into the stirrup 38. The user then reverses the direction of the drill 28 to rotate the drum 22 in a counterclockwise direction. As the drum 22 moves in the counterclockwise direction, the cable 48 winds around the drum 22, thereby pulling the second set of pulleys 34 and the attached stirrup 38 upwardly toward the first set of pulleys 32.

Once the user reaches an acceptable height, the user may stop the cordless drill and finish mounting the animal or apparatus. The user can then disconnect the drill 28 from the shaft 26 and store the drill 28 while riding.

When the user dismounts the animal or apparatus to which the stirrup device is fastened, the user reconnects the drill 28 to the shaft 26 and swings his other leg around the animal or apparatus such that both legs are adjacent the stirrup device. With the tool end of the cordless drill 28 inserted into the axial shaft 26, the user simply reverses the direction of rotation of the tool end of the drill to rotate the drum 22 in a clockwise direction such that the stirrup 38 is lowered.

As shown in FIG. 3, an extended flexible shaft 50 may be attached between the drill 28 and the axial shaft 26. The operation is the same as described with reference to FIG. 1. However, the extended flexible shaft 50 permits movement of the electric drill 28 while it is inserted in and rotating the extended flexible shaft 50. This configuration allows the user flexibility in positioning and handling the electric drill 28 while mounting or dismounting the animal or apparatus.

Finally, in FIG. 4 the operation of lowering and raising the stirrup 38 is functionally the same. However, rather than using a cordless electric drill 28 as shown in FIGS. 1 and 3, the user simply needs to activate the attached rotating motor 52 by means of a switch, operating button, lever, or the like, to rotate the drum 22 in either a clockwise or counterclockwise direction as desired by the user.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

What is claimed is:

1. A stirrup device for lifting a person comprising:

a mounting piece;

a drum rotatably connected to the mounting piece;

a pulley system;

a cable engaging the drum and the pulley system;

a stirrup supported by the cable and pulley arrangement; and a motor configured and arranged to rotate the drum.

2. The stirrup device of claim 1 wherein the motor is a cordless electric drill.

3. The stirrup device of claim 2 further comprising a flexible shaft configured and arranged to transfer motive force from the drill to the drum.

4. The stirrup device of claim 1 wherein the motor is configured to be electrically connected to a battery.

5. The stirrup device of claim 1 wherein the pulley system comprises upper and lower pulleys, each of the upper and lower pulleys having at least one pulley wheel engaged by the cable.

6. The stirrup device of claim 5 wherein the upper pulley includes a second pulley wheel axially aligned with the one pulley wheel of the upper pulley;

the lower pulley includes a second pulley wheel axially aligned with the one pulley wheel of the lower pulley; and the cable engages the second pulley wheel of the upper pulley and the second pulley wheel of the lower pulley.

7. A stirrup device for lifting a person comprising:

a mounting piece;

a drum rotatably connected to the mounting piece, the drum being configured to be connected to an electric drill;

a pulley system;

a cable engaging the drum and the pulley system; and a stirrup supported by the cable and pulley system.

8. The stirrup device of claim 7 further comprising a flexible shaft configured and arranged to transfer motive force from the drill to the drum.

9. The stirrup device of claim 7 wherein the pulley system comprises upper and lower pulleys, each of the upper and lower pulleys having at least one pulley wheel engaged by the cable.

10. The stirrup device of claim 9 wherein the upper pulley includes a second pulley wheel axially aligned with the one pulley wheel of the upper pulley;

the lower pulley includes a second pulley wheel axially aligned with the one pulley wheel of the lower pulley; and the cable engages the second pulley wheel of the upper pulley and the second pulley wheel of the lower pulley.

11. A stirrup device for lifting a person comprising:

a mounting piece;

a drum rotatably attached to the mounting piece and adapted to alternately receive a first force to rotate the drum in a first direction and a second force to rotate the drum in a second direction;

a pulley system including upper and lower pulleys, each of the upper and lower pulleys having at least one pulley wheel;

a cable connected to the drum and engaging the pulley wheels of the upper and lower pulleys; and a stirrup supported by the cable and pulley system.

12. The stirrup device according to claim 11 further comprising an extended flexible shaft, having first and second ends, the first end of the flexible shaft adapted to receive a tool end of an electric drill for rotation therewith when the drill is activated to selectably rotate the tool end in the first direction and the second direction, the second end of the flexible shaft configured and arranged to drive the drum.

13. The stirrup device according to claim 11 wherein the drum includes an axial shaft adapted to receive a tool end of an electric drill for rotation therewith when the drill is activated to selectably rotate the tool end in the first direction and the second direction.

14. The stirrup device according to claim 11 further comprising a rotating motor configured and arranged to drive the drum, the rotating motor configured to selectably impart the first force on the drum to rotate the drum in the first direction and the second force on the drum to rotate the drum in the second direction.

15. A method of lifting and lowering a person with a stirrup device having a drum adapted to receive a rotating force from an electric drill, a pulley system, a stirrup operably connected to the pulley system, and a cable engaging the drum and the pulley system, the method comprising the steps of:

placing the electric drill into driving engagement with the drum;

activating the electric drill to rotate the drum in a first direction, whereby the pulley system lowers the stirrup;

inserting a foot of the person into the stirrup;

activating the electric drill to rotate the drum in a second direction, said second direction opposite to said first direction, whereby the pulley system lifts the stirrup; and disconnecting the electric drill from the drum.

16. The method according to claim 15 further comprising the steps of:

placing the electric drill into driving engagement with the drum;

moving the body of the person to be adjacent the stirrup device with the foot of the person inserted in the stirrup; and activating the electric drill to rotate the drum in the first direction, whereby the pulley system lowers the stirrup.

17. The method according to claim 15 wherein the stirrup device further includes an extended flexible shaft configured and arranged to transfer motive force from the drill to the drum;

the step of placing the electric drill into driving engagement with the drum includes the step of inserting the tool end of the electric drill into the opposite end of the flexible shaft;

the step of activating the electric drill to rotate the drum in the first direction includes the step of moving the electric drill to a desired position; and the step of activating the electric drill to rotate the drum in the second direction includes the step of moving the electric drill to a desired position.

* * * * *

UNITED STATES PATENT AND TRADEMARK OFFICE

CERTIFICATE OF CORRECTION

PATENT NO. : 5,738,340

DATED : APRIL 14, 1998

INVENTOR(S) : BRANTNER

It is certified that error appears in the above-identified patent and that said Letters Patent is hereby corrected as shown below:

In column 4, line 60 (Claim 1): "arrangement" should read —system—.

Signed and Sealed this

Fifteenth Day of May, 2001

*Attest:*

NICHOLAS P. GODICI

*Attesting Officer*

*Acting Director of the United States Patent and Trademark Office*